US008701887B2

(12) United States Patent
Baker et al.

(10) Patent No.: US 8,701,887 B2
(45) Date of Patent: Apr. 22, 2014

(54) STACKABLE CONTAINER

(75) Inventors: Gerald Baker, Wauwatosa, WI (US); Thomas Murphy, Lake Mills, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 1117 days.

(21) Appl. No.: 12/189,537

(22) Filed: Aug. 11, 2008

(65) Prior Publication Data

US 2010/0025279 A1 Feb. 4, 2010

Related U.S. Application Data

(60) Provisional application No. 61/085,273, filed on Jul. 31, 2008.

(51) Int. Cl.
*B65D 21/02* (2006.01)

(52) U.S. Cl.
CPC ..... *B65D 21/0213* (2013.01); *B65D 21/0215* (2013.01); *B65D 21/0209* (2013.01)
USPC ..... 206/509; 220/508; 220/509; 220/23.83; 220/610; 220/270; 220/781; 220/380; 206/503

(58) Field of Classification Search
USPC ..... 206/501, 508, 499, 509, 503; 220/23.83, 610, 270, 781, 380; 413/4
See application file for complete search history.

(56) References Cited

U.S. PATENT DOCUMENTS

| | | | | |
|---|---|---|---|---|
| 163,747 | A | 5/1875 | Cummings | |
| 2,064,526 | A * | 12/1936 | Engel | 206/509 |
| 2,245,430 | A | 6/1941 | Courtright et al. | |
| 2,288,182 | A | 6/1942 | Curtin | |
| 2,310,420 | A | 2/1943 | Graham | |
| 2,553,559 | A | 5/1951 | Eckman | |
| 2,833,452 | A | 5/1958 | Drummond et al. | |
| 2,899,096 | A | 8/1959 | Henchert et al. | |
| 3,279,640 | A | 10/1966 | Dodson | |
| 3,288,342 | A | 11/1966 | Tinker | |
| 3,389,830 | A * | 6/1968 | Smith | 206/504 |
| 3,429,475 | A | 2/1969 | Scholtz | |
| 3,557,999 | A * | 1/1971 | Chagoyen | 220/269 |
| 4,199,073 | A | 4/1980 | Gombas | |
| 4,264,017 | A | 4/1981 | Karas et al. | |
| 4,363,404 | A | 12/1982 | Westphal | |
| 4,454,742 | A | 6/1984 | Gombas | |
| 4,646,930 | A * | 3/1987 | Karas et al. | 220/606 |
| 4,707,213 | A | 11/1987 | Mohr et al. | |
| 4,744,465 | A | 5/1988 | Parker | |
| 4,754,113 | A | 6/1988 | Mohr et al. | |
| 4,967,538 | A | 11/1990 | Leftault, Jr. et al. | |

(Continued)

*Primary Examiner* — Robert J Hicks
*Assistant Examiner* — Kareen Rush
(74) *Attorney, Agent, or Firm* — Reinhart Boerner Van Deuren s.c.

(57) ABSTRACT

A container adapted to be stacked on top of a second container is provided. The container includes a first end wall and a sidewall having a first end and a second end. The container includes a first seam coupling the first end wall to the first end of the sidewall, the first seam including a shoulder extending inwardly from an outer surface of the first seam. The container includes an alignment feature extending from the shoulder away from the first end wall. The alignment feature is adapted to align the container relative to the second container and to resist lateral movement of the container relative to the second container when the container is stacked on top of the second container.

24 Claims, 10 Drawing Sheets

(56) References Cited

U.S. PATENT DOCUMENTS

| | | | | | |
|---|---|---|---|---|---|
| 5,000,905 | A | | 3/1991 | Cox et al. | |
| 5,109,653 | A | | 5/1992 | Kubis et al. | |
| 5,163,073 | A | | 11/1992 | Chasteen et al. | |
| 5,169,017 | A | * | 12/1992 | Cooper et al. | 220/273 |
| 5,188,497 | A | | 2/1993 | Hantelmann et al. | |
| 5,226,518 | A | | 7/1993 | Purcell et al. | |
| 5,249,448 | A | | 10/1993 | Fedor et al. | |
| 5,368,176 | A | | 11/1994 | Thanisch | |
| 5,392,803 | A | | 2/1995 | Bruce | |
| 5,421,480 | A | | 6/1995 | Cudzik | |
| 5,448,903 | A | | 9/1995 | Johnson | |
| 5,504,271 | A | | 4/1996 | Curtis et al. | |
| 5,542,277 | A | | 8/1996 | Dunwoody | |
| 5,549,468 | A | | 8/1996 | Mitchell et al. | |
| 5,573,133 | A | * | 11/1996 | Park | 220/4.27 |
| 5,597,284 | A | | 1/1997 | Weltlich et al. | |
| 5,617,755 | A | | 4/1997 | Cheers et al. | |
| 5,669,523 | A | * | 9/1997 | Mueller et al. | 220/4.27 |
| 5,680,952 | A | | 10/1997 | Chasteen | |
| 5,688,466 | A | | 11/1997 | Mitchell et al. | |
| 5,692,409 | A | | 12/1997 | Cheers et al. | |
| 5,740,914 | A | | 4/1998 | Herzog | |
| 5,809,860 | A | | 9/1998 | Haaser | |
| 6,071,048 | A | | 6/2000 | Powell et al. | |
| 6,082,541 | A | | 7/2000 | Bewick | |
| 6,126,029 | A | * | 10/2000 | Storgaard | 220/271 |
| 6,206,222 | B1 | | 3/2001 | Cudzik | |
| 6,230,912 | B1 | | 5/2001 | Rashid | |
| 6,293,422 | B1 | | 9/2001 | Jentzsch et al. | |
| 6,294,131 | B1 | | 9/2001 | Jaffrey | |
| 6,341,709 | B1 | | 1/2002 | Wilson | |
| 6,351,980 | B1 | | 3/2002 | Jowitt et al. | |
| D485,765 | S | | 1/2004 | Thierjung et al. | |
| 6,974,046 | B2 | | 12/2005 | Shenkar | |
| 7,003,999 | B2 | | 2/2006 | Campo et al. | |
| 7,014,075 | B2 | | 3/2006 | Bonifacio et al. | |
| 2007/0102425 | A1 | | 5/2007 | Richardson et al. | |
| 2007/0108196 | A1 | | 5/2007 | Richardson et al. | |
| 2007/0108197 | A1 | | 5/2007 | Richardson et al. | |
| 2007/0108198 | A1 | | 5/2007 | Richardson et al. | |
| 2008/0302799 | A1 | | 12/2008 | Moore et al. | |
| 2010/0025279 | A1 | | 2/2010 | Baker et al. | |
| 2010/0025281 | A1 | | 2/2010 | Baker et al. | |

* cited by examiner

STACKABLE CONTAINER

CROSS-REFERENCE TO RELATED PATENT APPLICATION

This application claims the benefit of U.S. Provisional Application No. 61/085,273, filed Jul. 31, 2008, which is incorporated herein by reference in its entirety.

FIELD OF THE INVENTION

The present invention relates generally to containers. In particular, the present invention relates to containers having features that provide stacking properties.

BACKGROUND OF THE INVENTION

Containers are used to store a variety of materials, and containers must often meet a wide variety of requirements depending on the intended use. In particular, containers that store perishable materials, such as foods, drinks, pet foods, etc., typically should be able to maintain an airtight seal after the container is filled in order to prevent spoilage of the contents of the container. For example, in the case of metal food cans, the integrity of the can body, the can end walls, and the seams should be maintained during manufacture, filling, cooking, processing, labeling, shipping, displaying, purchasing, home storage, etc. Containers designed to be stacked on top of each other typically should perform all of the functions of non-stackable containers.

Food and beverage containers typically will have at least one closure or can end. One type of food and beverage container is provided with a can end affixed to the container by folding or crimping material that is coupled to the can end with the material of the container body to create a seam such as a double seam. Such can ends may require the use of a tool, such as a can opener, to remove the can end. Other can ends (e.g., "pop-tops", "pull tops", easy open ends, converted end, convenience ends, convenience lids, etc.) may be provided with a ring or tab that allows the can end to be removed without the use of a tool. Such a can end may include a structure (e.g., a score, thin connecting metal, etc.) that provides a weakness in the can end that aids in the removal of the can end. In addition, the can end may be a thin sheet of material (e.g., metal foil, etc.) coupled to the container through the use of an adhesive or other mechanism. Another type of food or beverage container is provided with a closure that is affixed to the container primarily by the pressure differential between external atmospheric pressure and a lower internal pressure. Other types of closures (e.g., twist on/off closures, snap on/twist off closures, etc.) are affixed to the container mechanically.

During certain processes, containers are filled with hot, pre-cooked food then sealed for later consumption, commonly referred to as a "hot fill process." As the contents of the container cool, a vacuum develops inside the container. The resulting vacuum may partially or completely secure the closure to the body of the container. Foods packed with a hot fill process often have certain advantages. For example, end-users often appreciate the convenience of pre-cooked food contents as preparation times are often shorter.

During other processes, containers are filled with uncooked food, sealed, and the food, while in the sealed container, is cooked to the point of being commercially sterilized or "shelf stable." This process is commonly called a thermal process. During such a process, the required heat may be delivered by a pressurized device, or retort. Thermal processes also have certain advantages. First, the resulting shelf-stable package offers long-term storage of food in a hermetically sealed container. Second, cooking the food inside the container commercially sterilizes the food and the container at the same time. In addition, during some cooking procedures, multiple cans are pushed end to end to move the cans through the heating device. In other processes, metal food cans are rolled to facilitate movement of the cans through the process.

Containers may be stacked for a variety of reasons such as improved display, storage, transport, etc. of the containers. Accordingly, it would be desirable to provide a container having one or more features that provide improved stacking properties.

SUMMARY OF THE INVENTION

One embodiment of the invention relates to a container adapted to be stacked on top of a second container. The container includes a sidewall, the sidewall having a first end and a second end. The container also includes a first end wall and a first seam coupling the first end wall to the first end of the sidewall, the first seam including a shoulder extending inwardly from an outer surface of the first seam. The container further includes an alignment feature extending from the shoulder away from the first end wall. The alignment feature is adapted to align the container relative to the second container and to resist lateral movement of the container relative to the second container when the container is stacked on top of the second container.

Another embodiment of the invention relates to a container configured to be stacked on top of a second container. The container includes a body and an end wall coupled to the body, the end wall having a peripheral edge. The container further includes a bead positioned along the peripheral edge of the end wall and an alignment feature positioned on the bead. When the container is stacked on top of the second container, the alignment feature is adapted to resist lateral movement of the container relative to the second container.

Another embodiment of the stack of containers including a first container and a second container. The first container includes a body sidewall having a lower end, an end wall, a seam joining the end wall of the first container to the lower end of the body sidewall of first container, and an alignment feature. The second container includes a body sidewall having an upper end, an end wall, and a seam joining the end wall of the second container to the upper end of the body sidewall of second container. The first container is placed on top of the second container. The alignment feature prevents lateral movement of the first container relative to the second container without coming into contact with the end wall of the second container, and the second container supports the weight of the first container via a contact between the seam of the first container and the seam of the second container.

Another embodiment of the invention relates to a can end component adapted to be coupled to a flange located at one end of a can body. The can end component includes an end wall portion, a seaming portion, and a feature positioned between the end wall portion and the seaming portion, the feature extending axially away from the end wall portion. The seaming portion is adapted to be folded with the flange of the can body to form a double seam. The double seam includes a shoulder extending inwardly from an outer edge of the double seam. The feature is adapted to act as an alignment feature after formation of the double seam, the alignment feature extending from the shoulder of the double seam.

Another embodiment of the invention relates to a method for making a stackable can. The method including the step of providing a can end component, the can end component comprising a center portion and a seaming portion and the step of providing a can body, the can body having a first end, a sidewall, and a flange. The method further includes forming a double seam by folding the seaming portion and the flange together, the double seam having a shoulder extending inwardly from an outer edge of the double seam, and providing an alignment feature extending from the shoulder of the double seam and away from the can end component.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION OF THE PREFERRED EMBODIMENTS

Referring generally to the FIGURES a container, shown as a metal food can, is depicted having an alignment feature that aligns the container relative to a second container and that prevents lateral movement of the container relative to the second container when the container is stacked on top of the second container. The containers discussed herein may be used to hold perishable materials (e.g. food, drink, pet food, etc.). However, the alignment features discussed herein may be used with a container of any style, shape, size, etc., or with a container that holds materials other than perishable materials.

Figure 1:
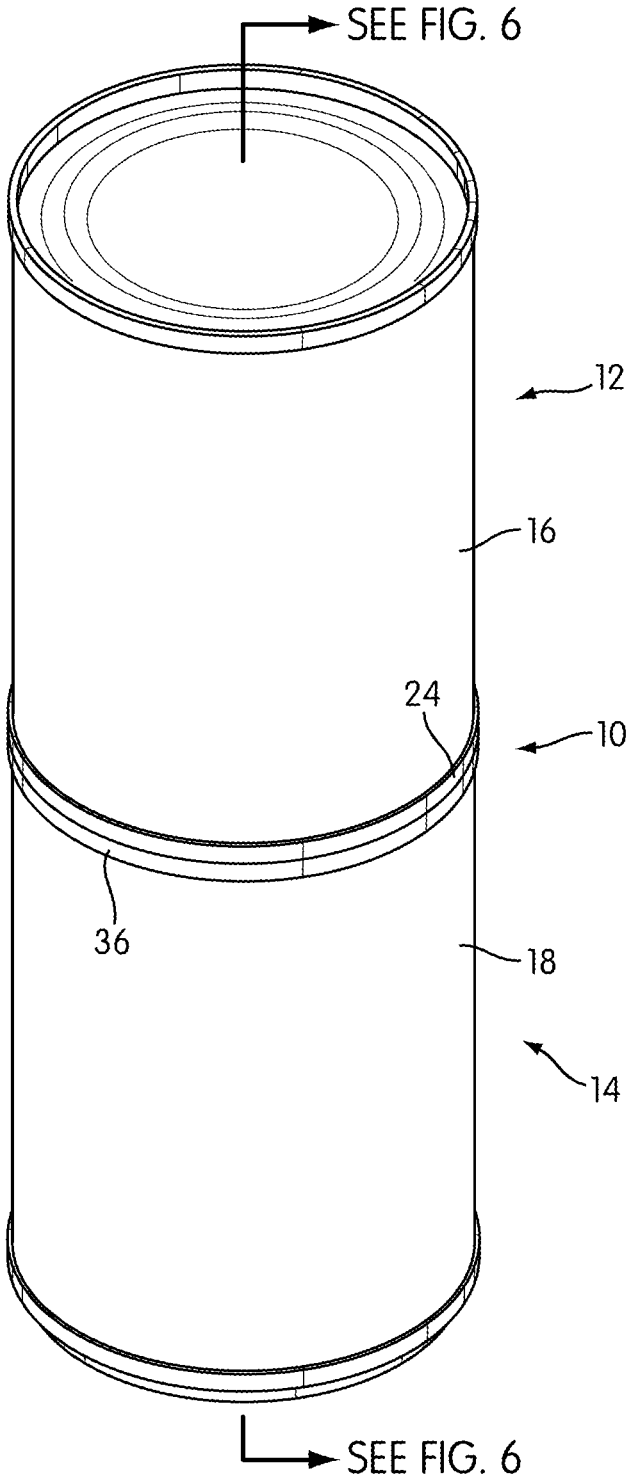
FIG. 1 shows a perspective view of a stack of two food cans according to an exemplary embodiment.

Referring to FIG. 1, a perspective view of a stack of containers, shown as stack 10, is depicted according to an exemplary embodiment. Stack 10 includes a first container, shown as upper can 12, and a second container, shown as lower can 14. Upper can 12 includes a sidewall (e.g., can body, container body, sidewall, etc), shown as body sidewall 16. Lower can 14 includes a sidewall, shown as body sidewall 18. In the exemplary embodiment of FIG. 1, body sidewall 16 and body sidewall 18, are shaped as cylinders having circular cross-sections. However, body sidewall 16 and/or body sidewall 18 may be shaped in a variety of ways (e.g., having other non-polygonal cross-sections, as a rectangular prism, a polygonal prism, any number of irregular shapes, etc.) as may be desirable for different applications or aesthetic reasons.

FIG. 1 shows upper can 12 stacked on top of lower can 14. Upper can 12 and/or lower can 14 includes one or more alignment features that aligns upper can 12 relative to lower can 14. As shown in FIG. 1, when upper can 12 and lower can 14 are positioned to create stack 10, upper can 12 is aligned relative to lower can 14 such that the longitudinal axes of upper can 12 and lower can 14 are in substantial alignment. In other embodiments, upper can 12 may be positioned relative to lower can 14 such that the longitudinal axes of upper can 12 and lower can 14 are not in substantial alignment. While only two cans are shown forming stack 10 in FIG. 1, one or more cans may be stacked below lower can 14 and/or above upper can 12.

Figure 2:
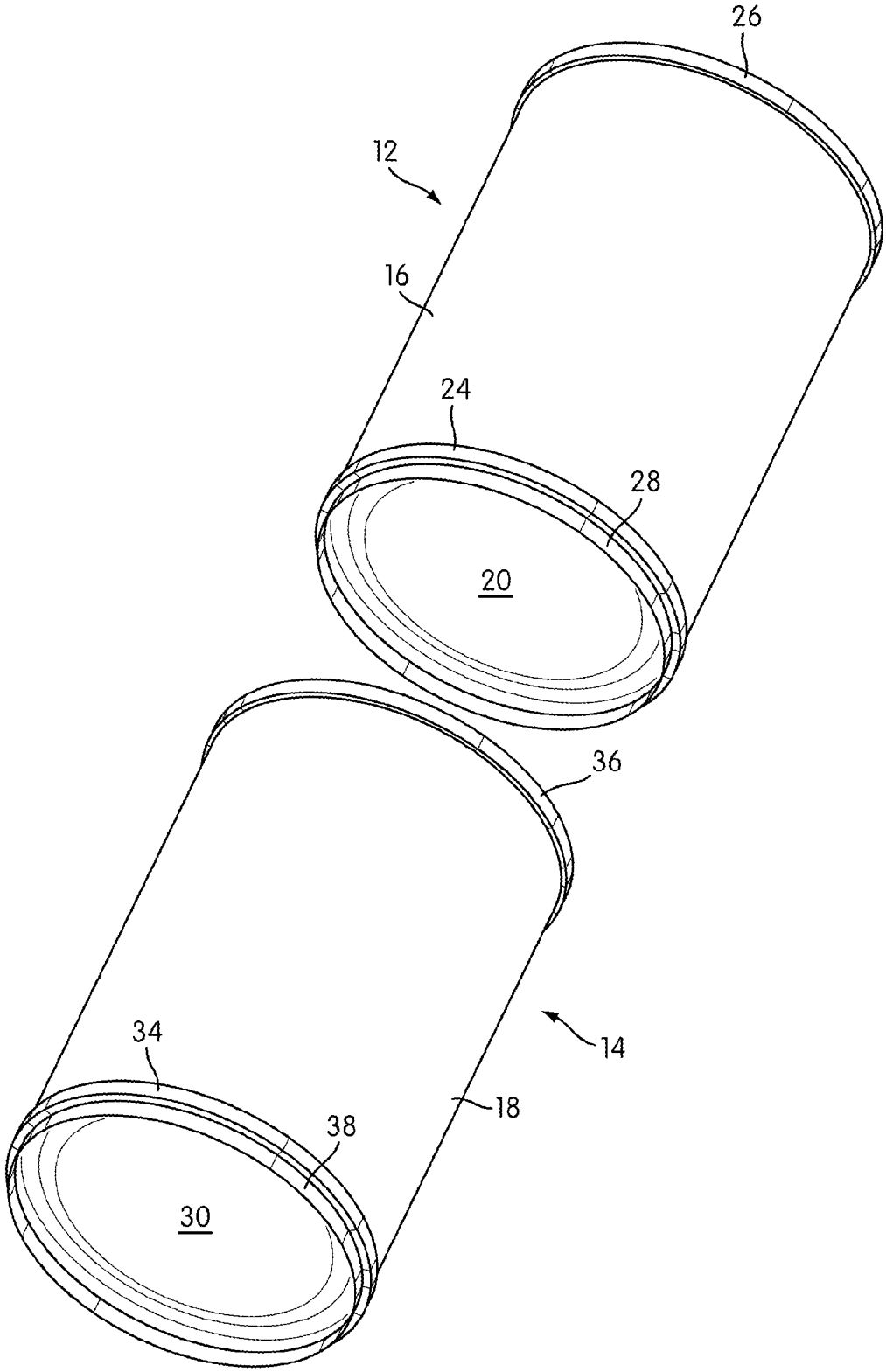
FIG. 2 shows a perspective view from below of the two food cans of FIG. 1 prior to being stacked on top of each other.
Figure 3:
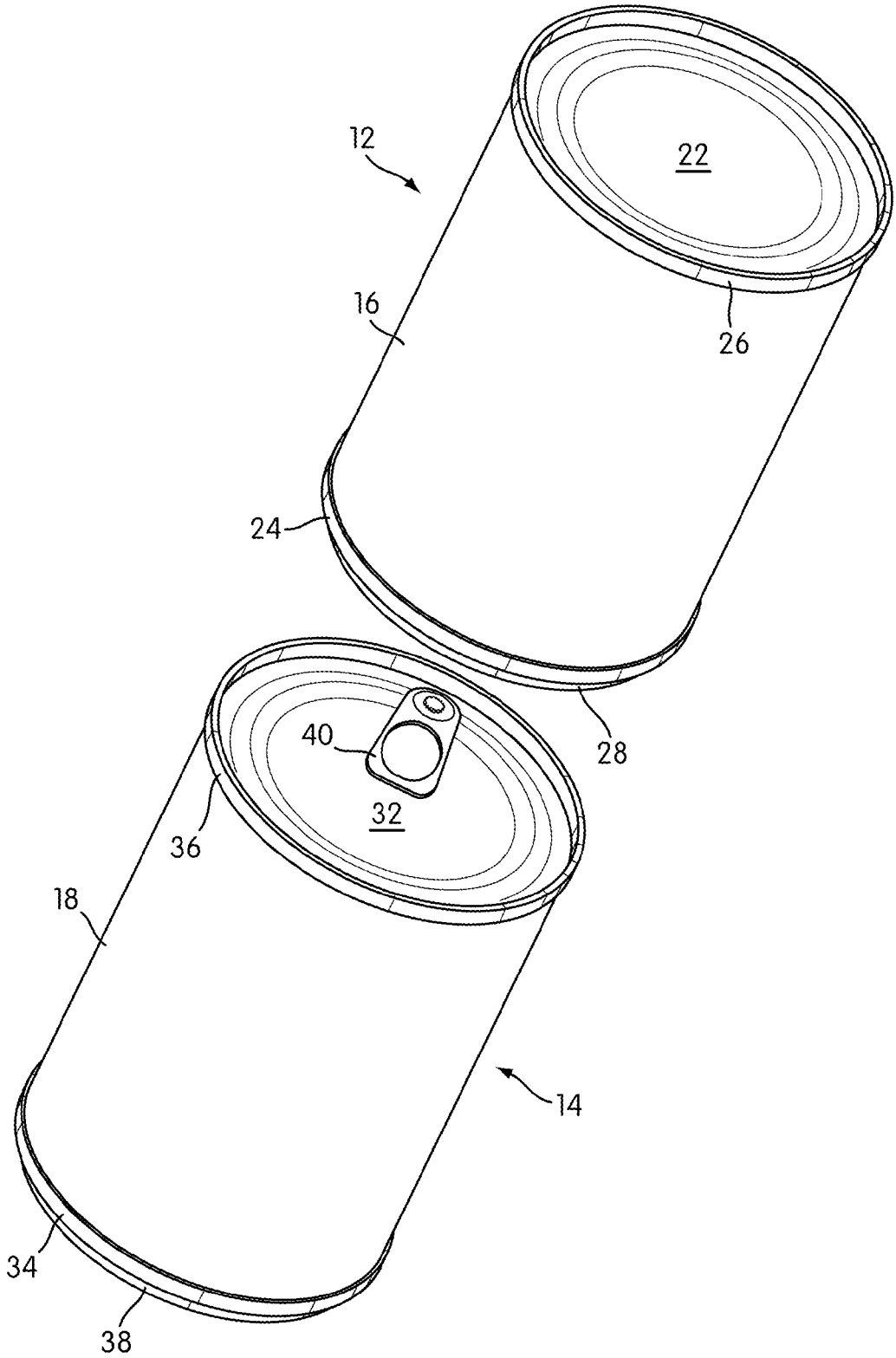
FIG. 3 shows a perspective view from above of the two food cans of FIG. 1 prior to being stacked on top of each other.

Referring to FIGS. 2 and 3, upper can 12 and lower can 14 are shown prior to creation of stack 10. Upper can 12 includes a first end wall (e.g., cover, lid, closure, etc.), shown as lower can end 20, and a second end wall, shown as upper can end 22 coupled to body sidewall 16. Upper can 12 includes a first bead or seam, shown as lower double seam 24, positioned along the peripheral edge of lower can end 20. Upper can 12 also includes a second bead or seam, shown as upper double seam 26. Lower double seam 24 couples lower can end 20 to a first end of the sidewall, shown as the lower end of body sidewall 16, and upper double seam 26 couples upper can end 22 to a second end of the sidewall, shown as the upper end of body sidewall 16. The seam or bead may be any of a number of structures such as welds, solders, mechanical attachments, etc. In addition, upper can 12 includes an alignment feature, shown as annular rim 28, extending from (e.g., positioned on, located on, etc.) lower double seam 24 and extending away from lower can end 20.

Lower can 14 includes a first end wall, shown as lower can end 30, and a second end wall, shown as upper can end 32. Lower can 14 includes a first bead or seam, shown as lower double seam 34, and a second bead or seam, shown as upper double seam 36. Lower double seam 34 couples lower can end 30 to a lower end of body sidewall 18, and upper double seam 36 couples upper can end 32 to an upper end of body sidewall 18. In addition, lower can 14 includes an alignment feature, shown as annular rim 38, positioned on lower double seam 34 and extending away from lower can end 30.

In FIGS. 2 and 3, lower can end 20, upper can end 22, and lower can end 30 are shown as conventional sanitary can ends (i.e., can ends attached to the body sidewall via a double seam and that typically require a tool, such as a can opener to remove). Upper can end 32 of lower can 14 includes a tab, shown as pull-tab 40. Pull-tab 40 allows upper can end 32 to be removed without a tool such as a can-opener. Upper can end 32 may also include structures (e.g., a score, thin connecting metal, etc.) that provides a weakness that aids in the removal of upper can end 32. In an exemplary embodiment, upper can end 32 may be an "EZO" convenience end, sold under the trademark "Quick Top" by Silgan Containers Corp.

In another embodiment, upper can end 22 and/or upper can end 32 may be a closure or lid attached to the respective body sidewall mechanically (e.g., snap on/off closures, twist on/off closures, tamper-proof closures, snap on/twist off closures, etc.) or via an internal vacuum.

In one embodiment upper can 12 and lower can 14 are adapted to be filled with perishable materials, such as food, pet food, drink, milk-based products, etc. In these embodiments, the can ends, double seams, and body sidewalls of upper can 12 and lower can 14 are adapted to maintain a hermetic seal after the container is filled and sealed.

While upper can end 32 is shown including a tab, the upper and/or lower can ends of any can in stack 10 may include a tab. In one exemplary embodiment, each can in stack 10 has one sanitary can end and one can end having a tab. In another embodiment, each can in stack 10 has two sanitary can ends. In another embodiment, each can in stack 10 is configured the same as the other cans (e.g., each can may have a lower can end that is a sanitary end and an upper can end having a tab). In this embodiment, the configuration of a particular can does not depend on its intended position in the stack. The various components of lower can 14 and upper can 12 may be made of aluminum, steel, various plastics, glass, ceramics, or any suitable material.

In one embodiment, one or more end wall of each container may be made of a metal foil, plastic, or other suitable material coupled to the body sidewall with an adhesive. In an exemplary embodiment, a container end wall (e.g., upper can end 22 or upper can end 32) may include a thin sheet or membrane attached to a flange or lip extending from the inner surface of the container body. The flange may be perpendicular to the inner surface of the container. In other exemplary embodiments, the flange may extend from the inner surface of the container such that the flange forms an angle greater than or less than 90 degrees with the inner surface of the container body. According to this embodiment, the container end may be attached to the lip or flange with an adhesive or other suitable material such that the container end seals the container.

Both upper can 12 and lower can 14 shown in FIGS. 1-3 are three piece cans (i.e., cans formed from two can end components and a sidewall piece). The body sidewall of a three piece can is formed from a single rectangular strip of metal that is rolled into a cylinder and opposing edges of the rectangular strip are welded together such that the body sidewall forms a cylinder or tube that is open at both ends. A side seam is formed where opposing edges of the rectangular strip are welded together. The two end walls of the container are formed by coupling the two can end components of the three piece can to the body sidewall by formation of a bead or seam, such as a double seam.

In another embodiment, upper can 12 and/or lower can 14 may be a two piece can (i.e., a can including a body and an end wall that are integrally formed and a separate can end component). The body sidewall of a two piece can may be integrally formed from a single piece of material. A bead may be positioned along the peripheral edge of the integrally formed end wall near the transition to the vertical surface of the body sidewall. The separate can end component is coupled to the end of the body sidewall opposite the integrally formed end wall. This may be accomplished via a seam such as a double seam.

Upper can 12 and lower can 14 may be various sized cans (e.g., 3 oz., 8 oz., 12 oz., 15 oz., etc.). In one embodiment, upper can 12 and lower can 14 have a height of approximately 4.5 inches. In another embodiment, the diameter of each can end of upper can 12 and lower can 14 is approximately 3 inches. In another embodiment, each can end of upper can 12 and lower can 14 is a standard 300 diameter can end.

Figure 4:
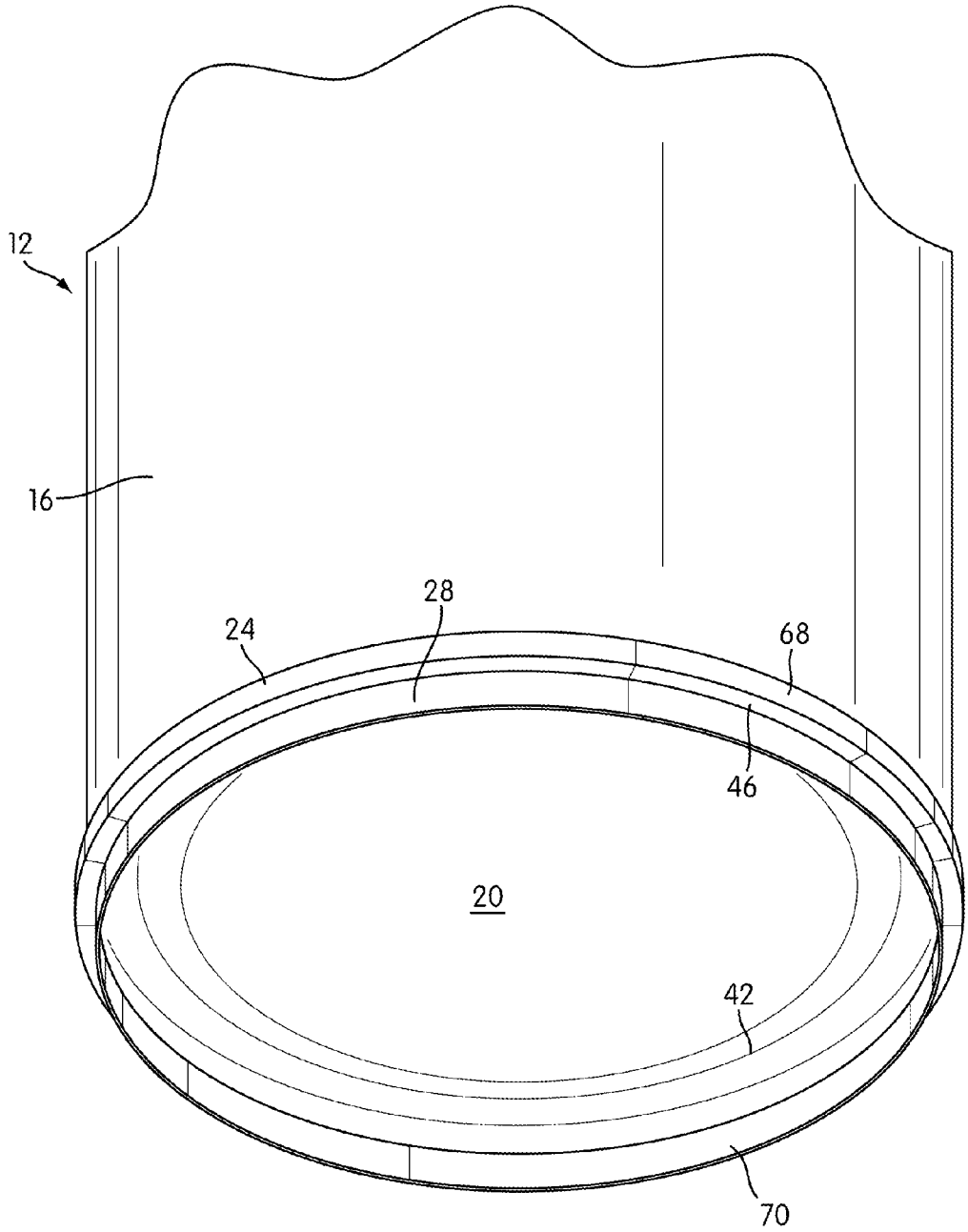
FIG. 4 shows a perspective view of a portion of a can including an annular rim according to an exemplary embodiment.

Referring to FIG. 4, a close up view of the lower portion of upper can 12 is shown. Lower double seam 24 includes a shoulder, shown as substantially horizontal shoulder 46. As shown in FIG. 4, upper can 12 includes an alignment feature, shown as annular rim 28, extending from substantially horizontal shoulder 46 of lower double seam 24 and extending away from lower can end 20. In addition, as shown in FIG. 4, the inner surface of annular rim 28 forms a continuous vertical surface with inner surface 70 of lower double seam 24. As shown in FIG. 4, the continuous vertical surface is perpendicular to lower can end 20.

The alignment feature may be any feature or features that facilitate stacking by aligning one container in the stack relative to another container and/or that acts to resist or prevent lateral movement of one container in the stack relative to another container. For example, annular rim 28 may include one or more cutout portion. In another embodiment, the alignment feature may include one or more portions of material extending from the bead or seam positioned at one end of the container.

As shown in FIG. 4, lower can end 20 includes a series of concentric beads 42. Concentric beads 42 are adapted to allow lower can end 20 to expand outward during the heating steps of certain processes, such as cooking or sterilization processes. Concentric beads 42 allow for expansion during processes in which the can is heated after being filled and sealed. This expansion may prevent upper can 12 from rupturing due to increased pressure caused by heating. In one embodiment, each end wall of each container in stack 10 includes one or more concentric beads similar to concentric beads 42. In another embodiment, the can ends of the containers of stack 10 include no concentric beads. In another embodiment, the lower portion of each can in stack 10 is constructed the same as the lower portion of upper can 12.

Figure 5:
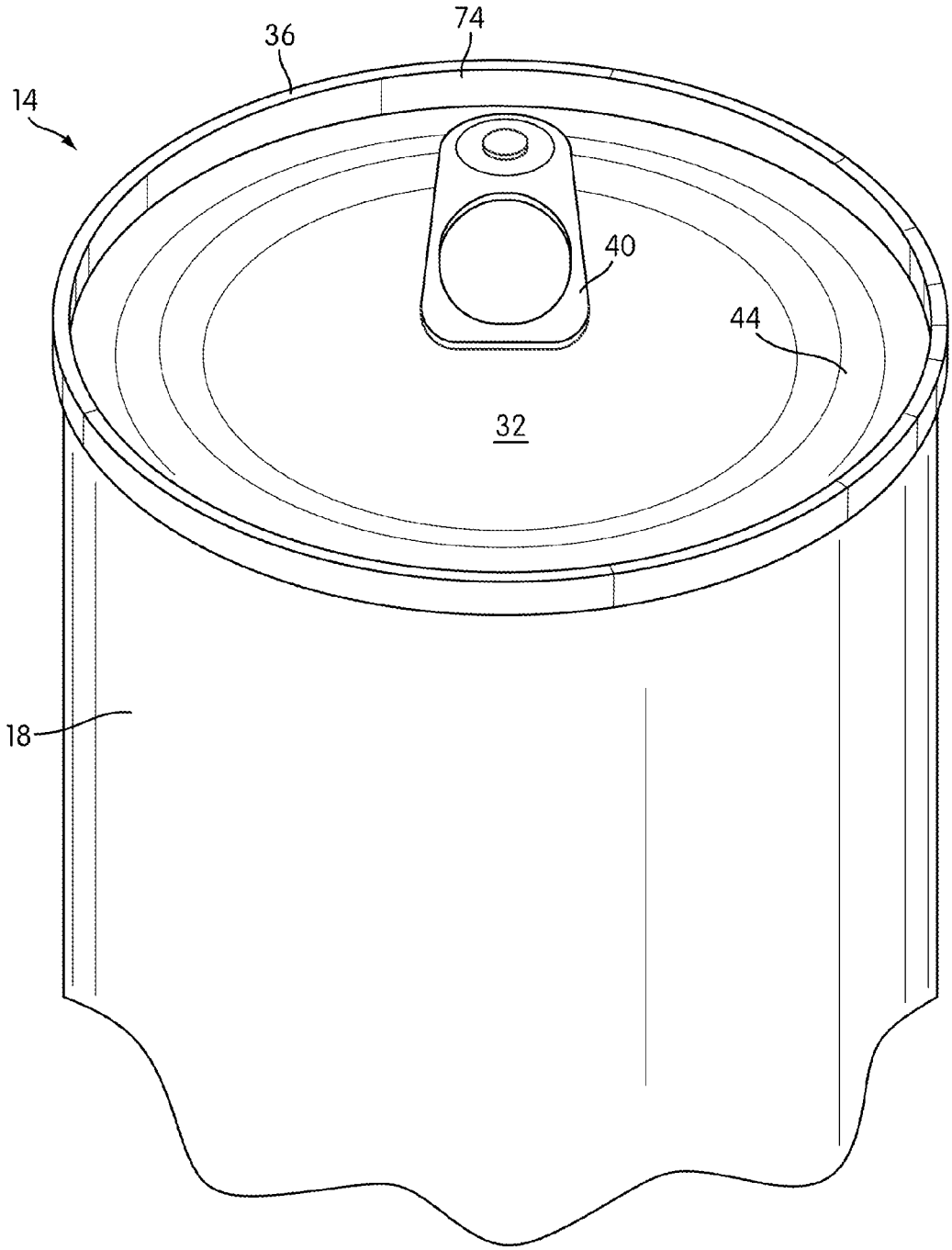
FIG. 5 shows a perspective view of a portion of a can adapted to receive an alignment feature according to an exemplary embodiment.

Referring to FIG. 5, a close up view of the upper portion of lower can 14 is shown. Upper can end 32 includes pull-tab 40 and a series of concentric beads 44. Upper can end 32 is substantially perpendicular to the vertical or longitudinal axis of body sidewall 18. Concentric beads 44 are positioned on upper can end 32. Upper can end 32 is substantially perpendicular to inner surface 74 of upper double seam 36. Concentric beads 44 function the same way as concentric beads 42. As can be seen in FIG. 5, upper can end 32 is countersunk relative to upper double seam 36. In one embodiment, the upper portion of each can in stack 10 is constructed the same as the upper portion of lower can 14. In another embodiment, the upper portion of each can in stack 10 is constructed the same as the upper portion of upper can 12.

Figure 6:
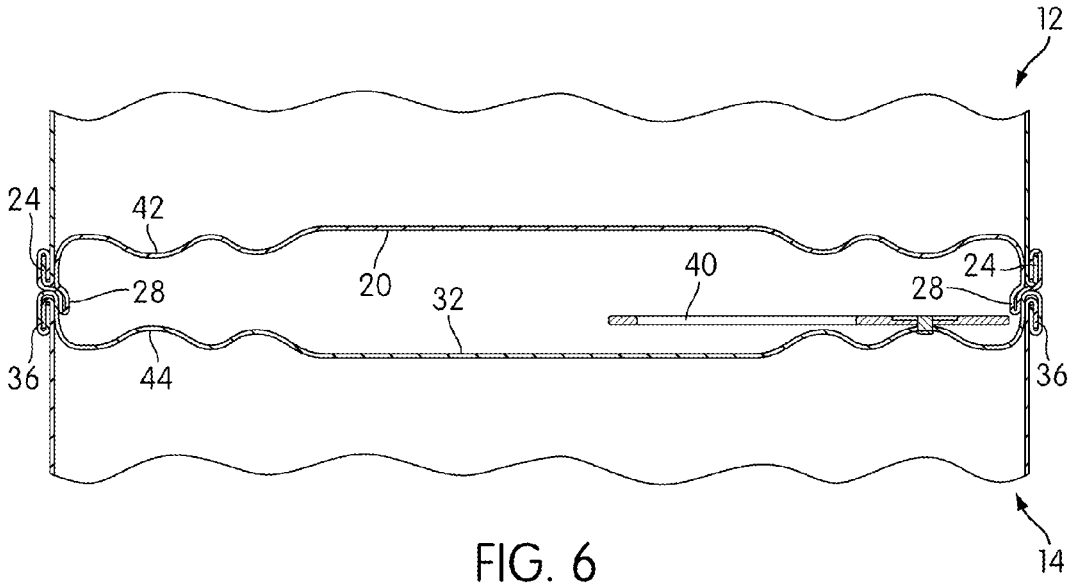
FIG. 6 shows a cross-sectional view of adjacent can portions of two stacked cans according to an exemplary embodiment.

FIG. 6 shows a cross-section of the lower portion of upper can 12 and the upper portion of lower can 14 after upper can 12 is placed on top of lower can 14 to create stack 10. In one embodiment, when upper can 12 is stacked on top of lower can 14, lower double seam 24 of upper can 12 is in contact with upper double seam 36 of lower can 14. As shown in the embodiment of FIG. 6, annular rim 28 is sized such that it does not come into contact with upper can end 32 of lower can 14. In this exemplary embodiment, the weight of upper can 12 (and the weight of any other cans stacked on top of upper can 12) is transferred to lower can 14 through the contact between the adjacent seams and not through a contact between annular rim 28 and upper can end 32.

Figure 7:
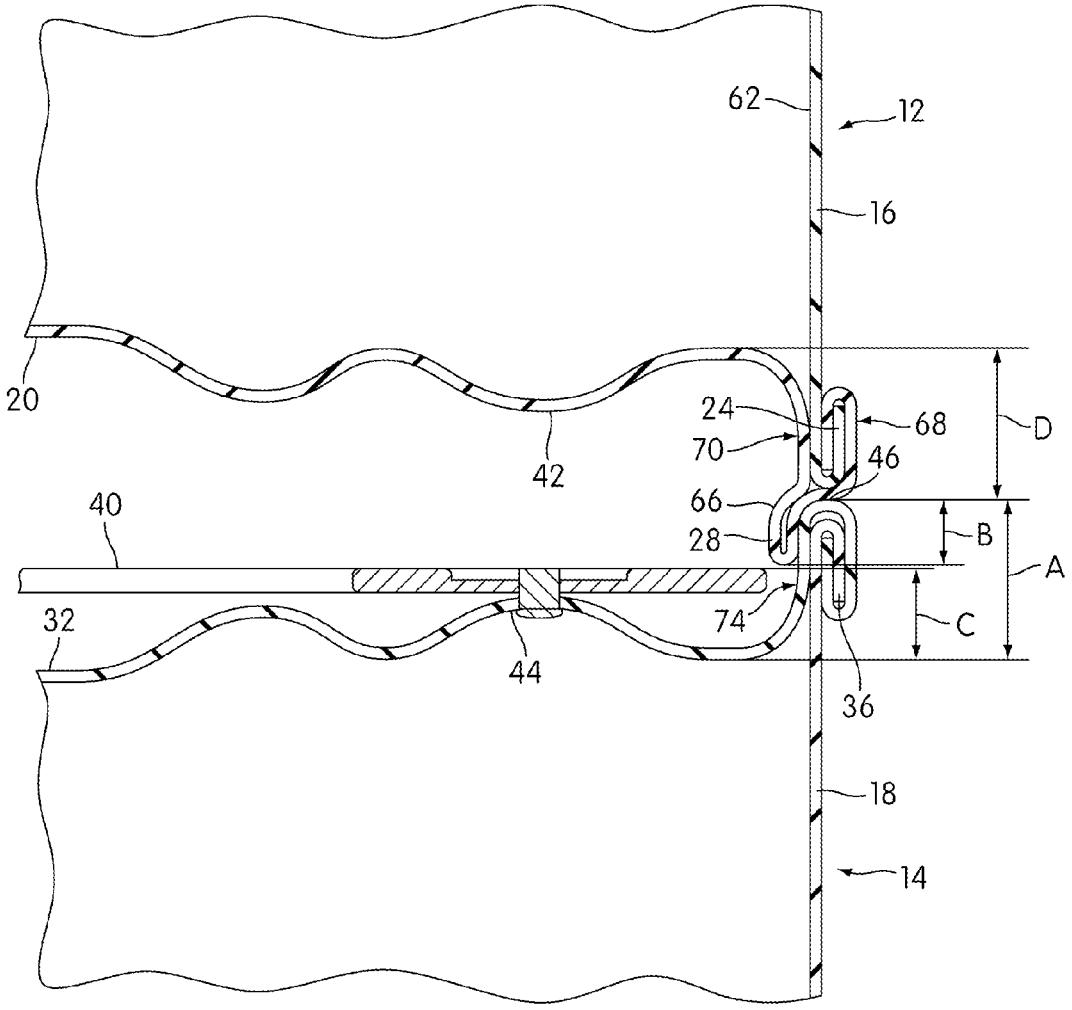
FIG. 7 shows a detailed cross-sectional view of a portion of FIG. 6.

FIG. 7 shows a detailed cross-section of the lower portion of upper can 12 and the upper portion of lower can 14 after upper can 12 is placed on top of lower can 14 to create stack 10. Lower can 14 includes upper double seam 36, upper can end 32, and pull-tab 40 coupled to upper can end 32. Upper can 12 includes lower can end 20, annular rim 28, and lower double seam 24.

As shown in FIG. 7, lower double seam 24 of upper can 12 includes an outer surface 68, an inner surface 70, and a shoulder, shown as substantially horizontal shoulder 46. Substantially horizontal shoulder 46 extends inwardly from outer surface 68. In the embodiment of FIG. 7, lower can end 20, inner surface 70 of lower double seam 24, annular rim 28, substantially horizontal shoulder 46, and outer surface 68 of lower double seam 24 are formed from a continuous piece of metal. As shown in FIG. 7, inner surface 70 of lower double seam 24 is a vertical surface positioned between lower can end 20 and annular rim 28. As shown in FIG. 7, the inner surface of annular rim 28 may include a rounded portion 66 between annular rim 28 and inner surface 70 of lower double seam 24. In another embodiment, an alignment feature, such as annular rim 28, may be positioned anywhere along inner surface 70 of lower double seam 24. In an alternative embodiment, an alignment feature, such as annular rim 28, may be positioned such that it extends from lower can end 20 as opposed to extending from either inner surface 70 of lower double seam 24 or substantially horizontal shoulder 46.

Substantially horizontal shoulder 46 has an inner portion (i.e., the portion of substantially horizontal shoulder 46 between its mid point and inner surface 70) and an outer portion (i.e., the portion of substantially horizontal shoulder 46 between its mid point and outer surface 68). Substantially horizontal shoulder 46 is perpendicular to the vertical axis of body sidewall 16 and is perpendicular to vertically positioned inner surface 70 and is parallel to the horizontal plane defined by lower can end 20 (i.e., the angle between the horizontal plane defined by lower can end 20 and the plane defined by substantially horizontal shoulder 46 is zero). In other embodiments, the shoulder may be angled either inwardly or outwardly such that the angle between the horizontal plane defined by lower can end 20 and the plane defined by substantially horizontal shoulder 46 is other than zero (e.g., angles between zero and five degrees, zero and twenty degrees, zero and forty five degrees, etc.).

Annular rim 28 acts to align upper can 12 relative to lower can 14 because as upper can 12 is brought into contact with lower can 14, annular rim 28 is received by lower can 14 such that annular rim 28 abuts an inner surface of upper double seam 36. In one embodiment, substantially horizontal shoulder 46 also defines a radially extending, downwardly facing surface that contacts upper double seam 36 of lower can 14 when the cans are stacked. In another embodiment, annular rim 28 is configured to align upper can 12 relative to lower can 14 such that the downwardly facing surface of substantially horizontal shoulder 46 contacts upper double seam 36 of lower can 14 when the cans are stacked. In another embodiment, annular rim 28 is configured to align upper can 12 relative to lower can 14 such that body sidewall 16 of upper can 12 is in axially alignment with body sidewall 18 of lower can 14 as shown in FIG. 7.

Annular rim 28 acts to resist and/or to prevent lateral relative movement between upper can 12 and lower can 14. As shown in FIG. 7, the alignment feature, shown as annular rim 28, extends from substantially horizontal shoulder 46 away from lower can end 20 of upper can 12. In the embodiment of FIG. 7, annular rim 28 extends from the inner portion of substantially horizontal shoulder 46 and specifically extends from the inner most edge of substantially horizontal shoulder 46. In this embodiment, the outer surface of annular rim 28 is adjacent the inner surface of upper double seam 36 of lower can 14. When a lateral force acts on either upper can 12 or lower can 14, the outer surface of annular rim 28 and the inner surface of upper double seam 36 will be brought into contact with each other, and this contact will resist and/or prevent lateral relative movement between upper can 12 and lower can 14. The resistance or prevention of relative lateral movement between upper can 12 and lower can 14 operates to prevent cans in stack 10 from shifting or tipping over.

In another embodiment, annular rim 28 has an outer surface that is in contact with the inner surface of upper double seam 36 in the absence of a lateral force acting on either upper can 12 or lower can 14. In addition, in this embodiment it should be noted that the radius of upper can 12 at lower double seam 24 (i.e., the distance from the center of lower can end 20 to the outer surface of lower double seam 24) is substantially the same as or equal to the radius of upper can end 32 at upper double seam 36 (i.e., the distance from the center of upper can end 32 to the outer surface of upper double seam 36). Because the radiuses are equal, a can having an upper portion configured as the upper portion of lower can 14 and a lower portion configured as the lower portion of upper can 12 will tend to roll in a straight line during various processes (e.g., manufacturing, filling, cooking, transporting, etc.). In another embodiment, annular rim 28 is sized to provide an interference fit within upper double seam 36.

In another embodiment, annular rim 28 extends from an outer half of substantially horizontal shoulder 46. In this embodiment, an inner surface of annular rim 28 is adjacent the outer surface of upper double seam 36 of lower can 14, and when a lateral force acts on either upper can 12 or lower can 14, the outer surface of upper double seam 36 and the inner surface of annular rim 28 will be brought into contact with each other and this contact will resist or prevent lateral relative movement between upper can 12 and lower can 14.

Referring to FIG. 7, upper can end 32 is countersunk relative to the upper surface of upper double seam 36 defining an end wall countersink distance, shown as upper can end countersink distance A. Further, annular rim 28 has an alignment feature length, shown as annular rim length B. Annular rim length B is the distance between the downwardly facing surface of substantially horizontal shoulder 46 and the distal most point of annular rim 28. In one embodiment, annular rim length B is the distance that annular rim 28 extends beyond lower double seam 24 of upper can 12. Pull-tab 40 includes a tab height, shown as pull-tab height C. In one embodiment, pull-tab height C is the distance between an upper most surface of pull-tab 40 and a substantially horizontal plane defined by upper can end 32. In the embodiment of FIG. 7, lower can end 20 is countersunk relative to lower double seam 24 defining an end wall countersink distance, shown as lower can end countersink distance D. In one embodiment, the lower portion of each can in stack 10 is configured as discussed above regarding the lower portion of upper can 12 and the upper portion of each can in stack 10 is configured as discuss above regarding the upper portion of lower can 14.

Referring to FIG. 7, in one embodiment annular rim length B is less than upper can end countersink distance A such that when upper can 12 is stacked on top of lower can 14, annular rim 28 does not come into contact with the substantially horizontal portions of upper can end 32. In this embodiment, the weight of upper can 12 is transferred to lower can 14 through the contact between lower double seam 24 and upper double seam 36 and not through annular rim 28. In addition, because the contact between lower double seam 24 and upper double seam 36 is positioned above and in axial alignment with body sidewall 18, the weight of upper can 12 is born through sidewall 18. This arrangement may allow lower can 14 to support more weight (e.g., more cans may be placed in stack 10) than if the weight were supported by upper can end 32. In one embodiment, annular rim 28 and pull-tab 40 are positioned such that annular rim 28 does not come into contact with pull-tab 40. This prevents an unintended breach in or removal of upper can end 32 that may be otherwise caused by contact between annular rim 28 and pull-tab 40 after creation of stack 10.

In the embodiment of FIG. 7, the distance between upper can end 32 and lower can end 20, shown as the combination (e.g., sum) of upper can end countersink distance A and lower can end countersink distance D, is greater than pull-tab height C. This configuration works to prevent an unintended breach in or removal of upper can end 32 that may be otherwise caused by contact between lower can end 20 and pull-tab 40 after creation of stack 10.

During certain heating processes, containers, such as upper can 12 and lower can 14, may be positioned horizontally and pushed end to end through a heating apparatus. While being pushed end to end, the interaction between the can ends of upper can 12 and lower can 14 may be the same as when the cans are stacked as shown in FIG. 7. Further, during certain heating processes, such as cooking or sterilization, the can ends of upper can 12 and lower can 14 may expand outward as a result of increased pressure within the cans. This expansion is facilitated by concentric beads 42 and 44 and acts to prevent rupture of the can. As can be seen in FIG. 7, if upper can end 32 and lower can end 20 expands outwardly, upper can end countersink distance A and lower can end countersink distance D will both decrease and pull-tab height C will increase. In one embodiment, upper can 12 and lower can 14 are constructed such that the sum of upper can end countersink distance A and lower can end countersink distance D is greater than pull-tab height C when the cans are subjected to heating. This configuration works to prevent an unintended breach in or removal of upper can end 32 that may be otherwise caused by contact between lower can end 20 and pull-tab 40 during a heating process. In another embodiment, upper can 12 and lower can 14 are constructed such that the sum of upper can end countersink distance A and lower can end countersink distance D is sufficient that lower can end 20 does not contact upper can end 32 when the cans are subjected to heating. It should be understood that following such a heating procedure, the contents of the can will cool, returning the cans to the unexpanded state as shown in FIG. 7.

According to an exemplary embodiment, upper can 12 and/or lower can 14 may include a liner (e.g., an insert, coating, lining, etc.), shown as protective coating 62. Protective coating 62 is positioned within the interior chamber of upper can 12 and is attached to the inner surface of body sidewall 16. Protective coating 62 acts to protect the material of the container from degradation that may be caused by the contents of the container. In an exemplary embodiment, protective coating 62 may be a coating that may be applied via spraying or any other suitable method. As shown in FIG. 7, the material that forms inner surface 70 abuts the inner surface of sidewall 16 close to the point where inner surface 70 transitions to lower can end 20. This allows for protective coating 62 to fully coat the interior of upper can 12. A gap between the material that forms inner surface 70 and the inner surface of sidewall 16 that extends into annular rim 28 may make complete coverage of the interior of upper can 12 with protective coating 62 difficult because it may be difficult to force protective coating 62 into narrow spaces.

According to an exemplary embodiment, the interior surface of the container material is pre-coated with protective coating 62 before the container is formed. According to various other exemplary embodiments, the interior and/or exterior of the container are coated with protective coating 62 after the container is formed or substantially formed. Different coatings may be provided for different food applications. For example, the liner or coating may be selected to protect the material of the container from acidic contents, such as carbonated beverages, tomatoes, tomato pastes/sauces, etc. The coating material may be a vinyl, polyester, epoxy, and/or other suitable preservative spray. The interior surfaces of the container ends may also be coated with a protective coating as described above.

Figure 8A:
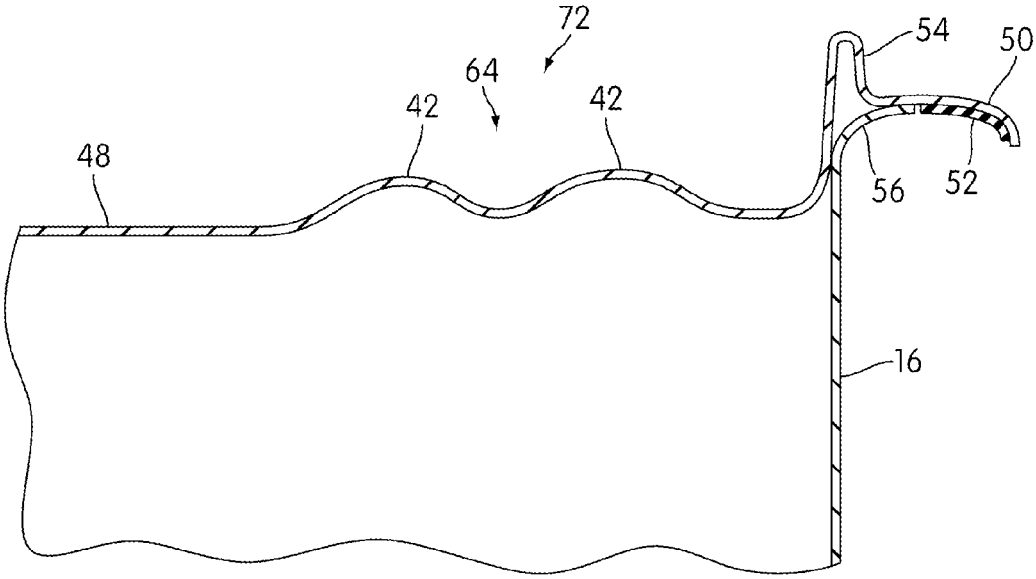
FIG. 8*a* shows a cross-sectional view of a can end component positioned adjacent to a can body prior to the formation of a double seam, according to an exemplary embodiment.
Figure 8B:
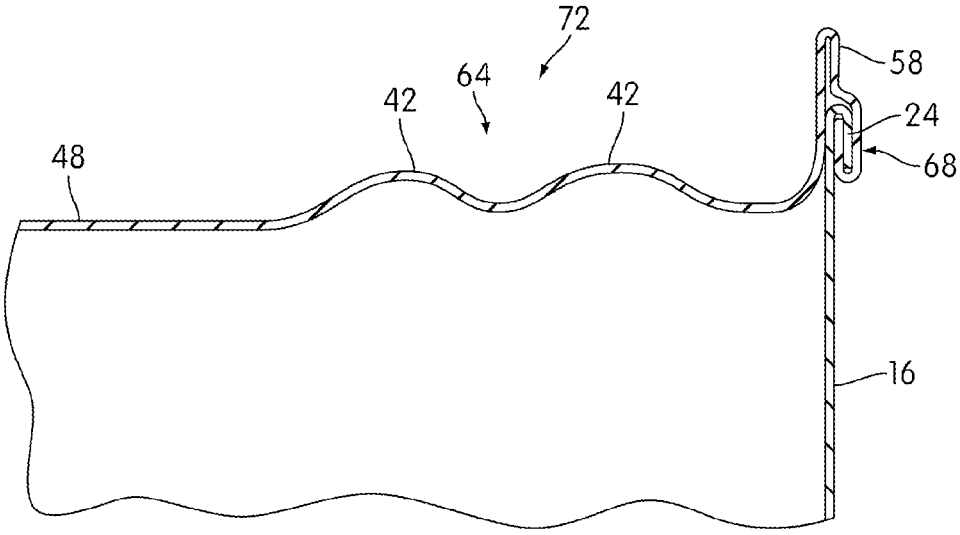
FIG. 8*b* shows a cross-sectional view of the can end component and can body of FIG. 8*a* following the formation of a double seam according to an exemplary embodiment.
Figure 8C:
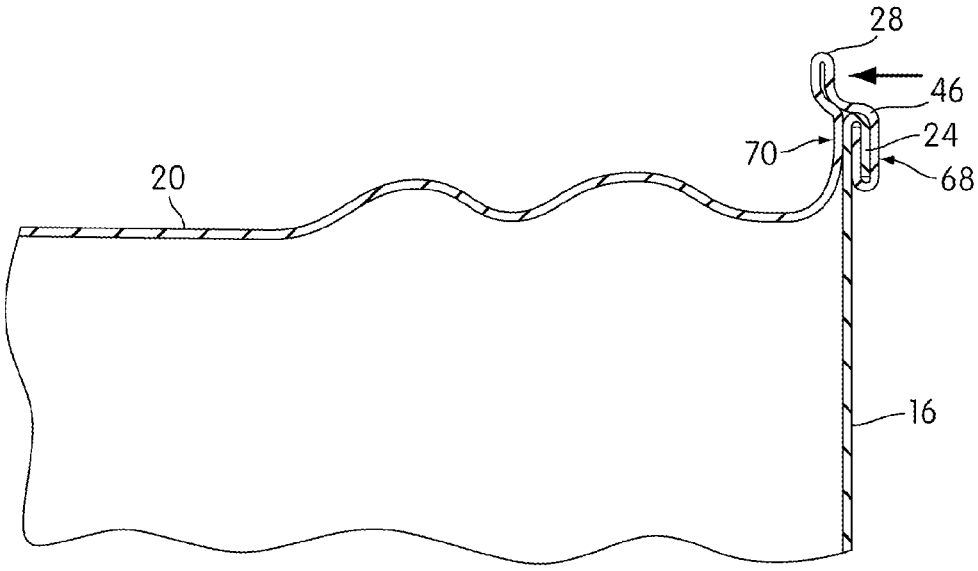
FIG. 8*c* shows a cross-sectional view of the can end component and can body of FIG. 8*b* following the formation of an alignment feature according to an exemplary embodiment.

FIGS. 8*a*-8*c* depict the coupling of a can end component to a can body and formation of an alignment feature, according to an exemplary embodiment. Referring to FIG. 8*a*, can end component 72 is shown positioned adjacent the lower end of body sidewall 16 prior to the formation of lower double seam 24. Can end component 72 includes an end wall portion 64. End wall portion 64 includes concentric beads 42, and a center portion, shown as center panel 48. End wall portion 64 is the portion of can end component 72 that forms lower can end 20 after the can end is coupled to the body side wall via a seam such as a double seam. Can end component 72 also includes a seaming portion, shown as seaming panel 50, and a feature, shown as annular bead 54. In one embodiment, seaming panel 50 includes a sealing compound 52.

Body sidewall 16 includes a flange, shown as seaming flange 56. Seaming flange 56 extends outwardly from body sidewall 16. As shown, in FIG. 8*a*, prior to the formation of lower double seam 24, can end component 72 is positioned adjacent body sidewall 16 such that seaming flange 56 is adjacent seaming panel 50 and annular bead 54 is positioned in axial alignment with body sidewall 16.

Referring to FIG. 8*b*, can end component 72 is shown following the formation of lower double seam 24. Lower double seam 24 is formed by folding seaming panel 50 and seaming flange 56 together and then pressing (e.g., ironing, compressing, flattening, and/or using force to compress) the folded together seaming panel 50 and seaming flange 56. After pressing, lower double seam 24 forms a hermetic seal such that air is not able to pass through lower double seam 24. In one embodiment, sealing compound 52 aids in the formation of the hermetic seal by filling in any gaps that might otherwise exist in lower double seam 24 between the folded material of seaming panel 50 and seaming flange 56. Sealing compound 52 is a rubberized material that is compressed and caused (e.g., forced, squeezed, etc.) to flow into any such gaps when the folded together seaming panel 50 and seaming flange 56 are pressed to form lower double seam 24.

In an exemplary embodiment, lower double seam 24 may be formed using a can seaming machine (e.g., a seamer, double seamer, closing machine, etc.). A seaming machine, may include a base plate and a chuck. Can end component 72 and body sidewall 16 may be held in place adjacent to each other by a load applied vertically through the base plate. The formation of the double seam may take place in two steps as discussed above. Lower double seam 24 may be formed using a seaming machine that holds body sidewall 16 and can end component 72 stationary on the chuck while seaming rolls revolve around body sidewall 16 and can end component 72 to form double seam 24. In a second style of seaming machine, body sidewall 16 and can end component 72 are held between a rotating chuck and base plate, which rotates body sidewall 16 and can end component 72 to form double seam 24.

As can be seen from FIG. 8*b*, annular bead 54 is pressed or compressed to form an annular rim 58 that extends from lower double seam 24. Following compression of annular bead 54, annular rim 58 is in axial alignment with body sidewall 16. Compression of annular bead 54 to form annular rim 58 may occur when seaming panel 50 is folded with seaming flange 56, when the folded together seaming panel 50 and seaming flange 56 are pressed to form lower double seam 24 or in a separate step that acts to form annular rim 58.

Referring to FIG. 8*c*, creation of an alignment feature, shown as annular rim 28, is shown according to an exemplary embodiment. As shown in FIG. 8*c*, a force is applied to annular rim 58 to bring annular rim 58 out of alignment with body sidewall 16 to create annular rim 28. As shown in FIG. 8*c*, the force is an inwardly directed force that causes annular rim 28 to extend from the inner portion of substantially horizontal shoulder 46 of lower double seam 24. In another embodiment, an outwardly directed force is applied to annular rim 58 to create an alignment feature the extends from an outer portion of substantially horizontal shoulder 46 of lower double seam 24. In another embodiment, the force shown in FIG. 8*c* is applied to annular bead 54 prior to creation of lower double seam 24 and/or prior to creation of annular rim 58.

Figure 9:
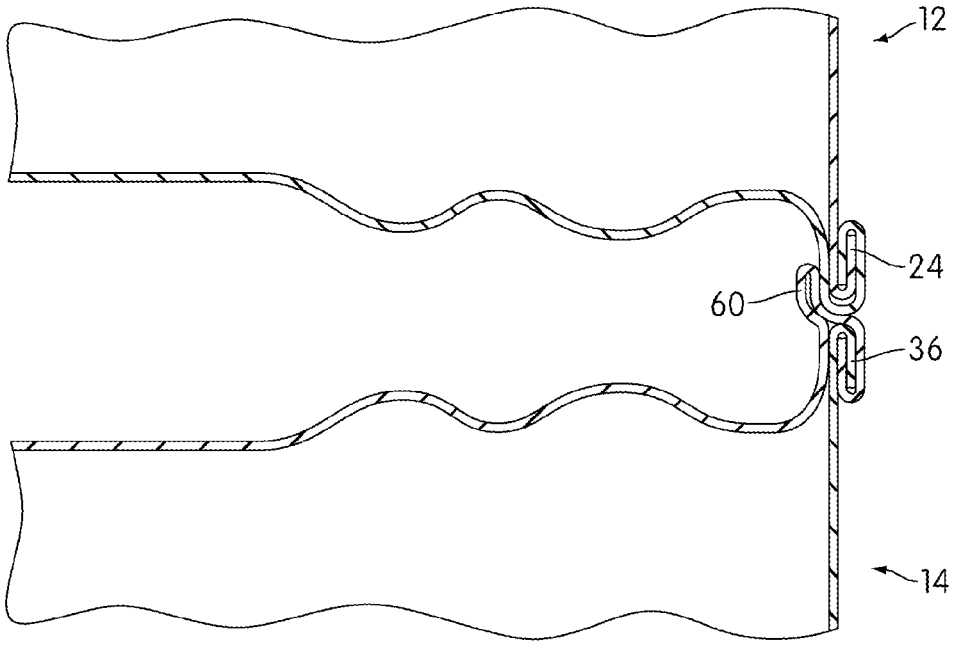
FIG. 9 shows a cross-sectional view of a portion of a can having an alignment feature received by a second can according to an exemplary embodiment.

FIG. 9 shows two stacked cans according to an exemplary embodiment. In FIG. 9, an alignment feature, shown as annular rim 60, extends from upper double seam 36 of lower can 14. Upper can 12 is placed on top of lower can 14, and annular rim 60 is received within lower double seam 24 of upper can 12.

Figure 10A:
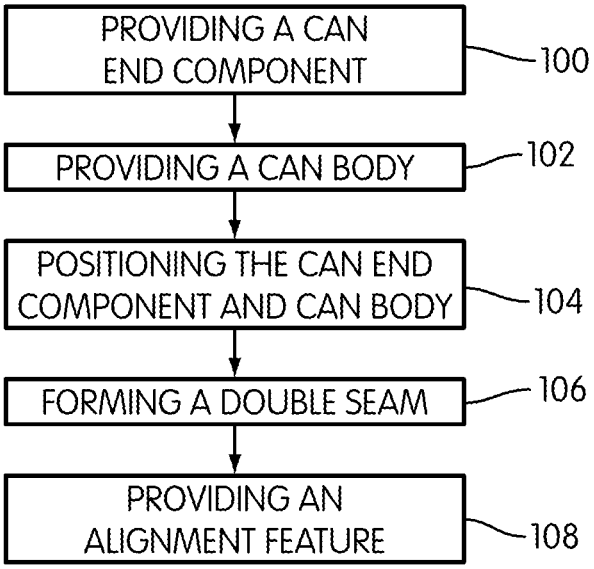
FIG. 10*a* shows a flow diagram of the creation of a can having an alignment feature according to an exemplary embodiment.

FIG. 10 is a flow chart of the creation of a container having an alignment feature according to an exemplary embodiment. At step 100 a can end component is provided. The can end component includes a center portion and a seaming portion. At step 102 a can body is provided. The can body includes a first end, a sidewall, and a flange. At step 104 the can end component is positioned adjacent the can body such that the flange of the can body is adjacent the seaming portion of the can end component. At step 106 a double seam is formed by folding the seaming portion and the flange together. The double seam formed during step 106 includes a shoulder. At step 108 an alignment feature is provided that extends from the shoulder of the double seam away from the now formed can end.

Figure 10B:
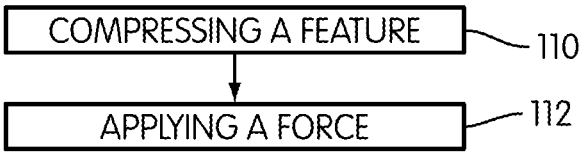
FIG. 10*b* shows a detailed flow diagram of step 108 shown in FIG. 10*a* according to an exemplary embodiment.

FIG. 10*b* is a detailed flow chart of step 108, according to an exemplary embodiment. At step 110, a feature, positioned between the center portion and seaming portion of the can end component, is compressed to create an annular rim extending from the double seam and positioned in axial alignment with the sidewall of the can body. At step 112 a force is applied to the annular rim created during step 110 to bring the annular rim out of axial alignment with the sidewall of the can body. In an exemplary embodiment of step 112, the force is an inwardly directed force which displaces the annular rim inwardly resulting in an alignment feature extending from an inner half of the double seam.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

It is important to note that the construction and arrangement of the container as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. Other substitutions, modifications, changes and omissions may be made in the design, operating conditions and arrangement of the exemplary embodiments without departing from the scope of the present application.

What is claimed is:

1. A container adapted to be stacked on top of a second container, the container comprising:

a first metal end wall;

a metal sidewall, the sidewall having a first end and a second end, wherein the second end is a free end configured to be coupled to a second metal end wall following filling of the container, wherein an inner surface of the first metal end wall and an inner surface of the metal sidewall define an interior contents chamber of the container;

a first seam coupling the first metal end wall to the first end of the metal sidewall, the first seam including a substantially horizontal shoulder extending inwardly from an outer surface of the first seam, the shoulder positioned below the first end of the metal sidewall; and an alignment feature extending directly from the shoulder away from the first metal end wall from a position below the first end of the metal sidewall, wherein the alignment feature is adapted to align the container relative to the second container and to resist lateral movement of the container relative to the second container when the container is stacked on top of the second container;

wherein the first metal end wall, the shoulder, the outer surface of the first seam and the alignment feature are integrally formed from a single piece of metal material.

2. The container of claim 1 wherein the alignment feature is adapted to align the container relative to the second container such that the first seam of the container is in contact with a seam of the second container when the container is stacked on top of the second container.

3. The container of claim 2 further wherein the weight of the container is transferred to the second container through the contact between the first seam of the container and the seam of the second container when the container is stacked on top of the second container.

4. The container of claim 1 further comprising:

the second metal end wall; and a second seam coupling the second metal end wall to the second end of the metal sidewall;

wherein the second metal end wall is countersunk relative to the second seam thereby defining a second end wall countersink distance.

5. The container of claim 4 wherein the alignment feature has an alignment feature length that is less than the second end wall countersink distance.

6. The container of claim 5 further comprising a tab coupled to the second metal end wall, the tab having a tab height, wherein the tab is adapted to allow removal of the second metal end wall from the container, wherein the first metal end wall is countersunk relative to the first seam thereby defining a first end wall countersink distance, and further wherein the sum of the first end wall countersink distance and the second end wall countersink distance is greater than the tab height.

7. The container of claim 6 wherein the sum of the first end wall countersink distance and the second end wall countersink distance is greater than the tab height when the container is subjected to heating.

8. The container of claim 1 wherein the alignment feature is an annular rim.

9. The container of claim 8 further comprising:

a flange coupled to the first end of the metal sidewall; and a seaming portion coupled to the first metal end wall;

wherein the seam is a double seam formed by folding the seaming portion and the flange together, wherein the metal sidewall and the metal end wall have circular cross-sections, and further wherein the annular rim extends from the inner portion of the shoulder.

10. A metal container configured to be stacked on top of a second container, the container comprising:

a metal body;

a metal end wall coupled to the body by a seam, the end wall having a peripheral edge at which the metal body and the metal end wall are joined by the seam, wherein the seam includes a vertical inner portion, a vertical outer portion and a shoulder extending between the vertical inner portion and the vertical outer portion, wherein the shoulder is the lowermost portion of the seam;

an alignment feature extending directly from the shoulder and away from the metal end wall;

wherein, when the container is stacked on top of the second container, the alignment feature is adapted to interact with the second container to resist lateral movement of the container relative to the second container;

wherein the metal end wall, the shoulder, the vertical inner portion of the seam, the vertical outer portion of the seam and the alignment feature are integrally formed from a single piece of metal material.

11. The container of claim 10 wherein the seam is a hermetic double seam coupling the end wall to the body.

12. The container of claim 11 wherein the shoulder is substantially horizontal shoulder and the alignment feature is positioned on a substantially horizontal shoulder.

13. The container of claim 10 wherein the vertical inner portion of the seam is in contact with the inner surface of the metal sidewall and the alignment feature is located between the innermost edge of the shoulder and the lowermost edge of the vertical inner portion of the seam.

14. The container of claim 10 wherein the seam includes an outer surface and the alignment feature is positioned on the outer surface.

15. A stack of metal containers comprising:

a first metal container comprising:

a metal body sidewall having a lower end;

a metal end wall; and a hermetic double seam formed from and joining the metal end wall of the first container to the lower end of the metal body sidewall of first container; and an alignment feature extending directly from the hermetic double seam and integrally formed with the material of the metal end wall of the first metal container; and a second metal container comprising:

a metal body sidewall having an upper end;

a metal end wall; and a hermetic double seam formed from and joining the metal end wall of the second container to the upper end of the metal body sidewall of second container;

wherein the first metal container is stacked on top of the second metal container;

wherein the second container axially supports the weight of the first container via contact between the seam of the first container and the seam of the second container to provide a gap between the alignment feature and the metal end wall of the second container while the alignment feature prevents lateral movement between the containers.

16. The stack of containers of claim 15 wherein the alignment feature is an annular rim extending from the hermetic double seam of the first container.

17. The stack of containers of claim 15 wherein the alignment feature has an outer surface that is in contact with an inner surface of the hermetic double seam of the second container.

18. The stack of containers of claim 15 wherein the second container further comprises a tab coupled to the metal end wall of the second container, and further wherein the distance between metal end walls of the first and second containers is great enough such that the tab does not contact the metal end wall of the first container.

19. A can end component adapted to be coupled to a flange located at one end of a can body, the can end component comprising:

an end wall portion;

a seaming portion; and a feature radially positioned between the end wall portion and the seaming portion and directly coupled to and extending from the seaming portion, the feature including an upper end, the feature extending axially away from the end wall portion, wherein the upper end of the feature is the uppermost portion of the can end component;

wherein the end wall portion, the seaming portion, and the feature are integrally formed from a single piece of metal material;

wherein the seaming portion is adapted to be folded with the flange of the can body to form a double seam, the feature is adapted to act as an alignment feature after formation of the double seam.

20. The can end component of claim 19 wherein the feature is an annular rim.

21. A metal container adapted to be stacked on top of a second container, the container comprising:

a metal sidewall, the metal sidewall having a first end and a second end;

a first metal end wall;

a second metal end wall;

a first seam coupling the first metal end wall to the first end of the metal sidewall, the first seam formed from folded together portions of the first metal end wall and the metal sidewall, the first seam including a shoulder formed from the first metal end wall and extending inwardly from an outer surface of the first seam, the shoulder positioned below the first end of the metal sidewall;

a second seam coupling the second metal end wall to the second end of the sidewall; and an alignment feature formed from the first metal end wall and extending directly from the shoulder away from the first metal end wall, wherein the alignment feature is adapted to align the container relative to the second container and to resist lateral movement of the container relative to the second container when the container is stacked on top of the second container;

wherein the first metal end wall, the shoulder, the outer surface of the first seam and the alignment feature are integrally formed from a single piece of metal material.

22. A container adapted to be stacked on top of a second container, the container comprising:

a sidewall, the sidewall having a first end and a second end opposite the first end, the sidewall comprising a seaming flange located at the second end;

a first metal end wall;

a hermetic seam coupling the first metal end wall to the first end of the sidewall, the sidewall adjacent to the hermetic seam being substantially perpendicular to the first metal end wall, the hermetic seam including a shoulder formed from the first metal end wall and extending inwardly from an outer surface of the hermetic seam; and an alignment feature formed from the first metal end wall and extending from the shoulder away from the first metal end wall from a position below the first end of the sidewall, wherein the alignment feature is adapted to align the container relative to the second container and to resist lateral movement of the container relative to the second container when the container is stacked on top of the second container.

23. The container of claim 1 further wherein:

the metal sidewall is formed from a first piece of metal material;

the first metal end wall, the shoulder, the outer surface of the first seam and the alignment feature are integrally formed from a single, second piece of metal material; and the seam is a hermetic double seam formed of folded together and compressed portions of the first piece of metal material and the second piece of metal material.

24. The container of claim 1 further comprising a protective coating located within the contents chamber of the container and attached to at least one of the inner surface of the first metal end wall and the inner surface of the metal sidewall.

* * * * *